US009091499B2

(12) United States Patent
Overstreet et al.

(10) Patent No.: US 9,091,499 B2
(45) Date of Patent: Jul. 28, 2015

(54) BOLT HOLD OPEN ACTUATOR FOR USE WITH AR-15/M16 TYPE FIREARMS

(71) Applicant: 22 Evolution LLC, Columbia, MO (US)

(72) Inventors: John L. Overstreet, Fayette, MO (US); Jordan Bowles, Columbia, MO (US); Tyson Bradshaw, Kirksville, MO (US); Craig Pudil, Boonville, MO (US)

(73) Assignee: 22 Evolution LLC, Columbia, MO (US)

( * ) Notice: Subject to any disclaimer, the term of this patent is extended or adjusted under 35 U.S.C. 154(b) by 160 days.

(21) Appl. No.: 13/789,228

(22) Filed: Mar. 7, 2013

(65) Prior Publication Data

US 2014/0060310 A1 Mar. 6, 2014

Related U.S. Application Data

(63) Continuation-in-part of application No. 12/987,653, filed on Jan. 10, 2011, now Pat. No. 8,479,635.

(60) Provisional application No. 61/321,951, filed on Apr. 8, 2010.

(51) Int. Cl.

| | |
|---|---|
| ***F41A 3/68*** | (2006.01) |
| ***F41A 9/70*** | (2006.01) |
| ***F41A 17/36*** | (2006.01) |

(52) U.S. Cl.

CPC ... *F41A 3/68* (2013.01); *F41A 9/70* (2013.01); *F41A 17/36* (2013.01)

(58) Field of Classification Search

USPC ..... 42/70.02, 1.02, 1.05, 50, 49.01, 49.02; 89/187.01, 189, 190, 181, 180, 138, 89/137, 197, 196

See application file for complete search history.

(56) References Cited

U.S. PATENT DOCUMENTS

| | | | | |
|---|---|---|---|---|
| 2,321,045 | A * | 6/1943 | Roemer | 89/138 |
| 2,538,799 | A | 1/1951 | Phillips et al. | |
| 3,540,142 | A | 11/1970 | Vartanian et al. | |
| 3,570,366 | A | 3/1971 | Nickel | |
| 3,688,640 | A | 9/1972 | Seecamp | |
| 3,776,095 | A | 12/1973 | Atchisson | |
| 3,846,928 | A | 11/1974 | Ruger et al. | |
| 4,057,003 | A | 11/1977 | Atchisson | |
| 4,058,922 | A | 11/1977 | Elbe et al. | |
| 4,069,607 | A * | 1/1978 | Jurek | 42/25 |
| 4,069,608 | A | 1/1978 | Jurek | |
| 4,098,016 | A | 7/1978 | Foote | |

(Continued)

*Primary Examiner* — Jonathan C Weber

(74) *Attorney, Agent, or Firm* — Gifford, Krass, Sprinkle, Anderson & Citkowski, P.C.; Douglas J. McEvoy

(57) ABSTRACT

A bolt hold open (BHOA) catch assembly configured for operating with rimfire ammunition for use with a firearm including a receiver with an exposed receiving chamber. A BHOA housing is supported upon the lower receiver in communication with a receiver chamber in communication with a bolt assembly. A catch is supported in elevatable fashion relative to an end of the actuator housing and an end most and downward extending structural portion of the elevatable catch is capable of being manipulated by an externally configured and toggled bolt catch so that an inner pivoting end portion thereof engages the structural portion to raise the BHOA supported catch into contact with a forwardly traveling bolt, such as upon release of a previously retracted charging handle. The BHOA catch can alternatively be actuated upwardly by a suitably configured follower associated with an attachable and cartridge holding magazine, this again following a last shot hold open protocol.

20 Claims, 12 Drawing Sheets

(56) References Cited

U.S. PATENT DOCUMENTS

| | | | | |
|---|---|---|---|---|
| 4,128,042 | A | 12/1978 | Atchisson | |
| 4,142,314 | A | 3/1979 | Foote | |
| 4,433,610 | A | 2/1984 | Tatro | |
| 4,455,919 | A | 6/1984 | Osborne et al. | |
| 4,617,749 | A * | 10/1986 | Jurek | 42/16 |
| 4,893,547 | A | 1/1990 | Atchisson | |
| 5,519,954 | A | 5/1996 | Garrett | |
| 5,608,981 | A | 3/1997 | Canaday | |
| 5,638,626 | A | 6/1997 | Westrom | |
| 6,070,352 | A | 6/2000 | Daigle | |
| 6,212,814 | B1 * | 4/2001 | Lambie | 42/75.03 |
| 6,510,778 | B1 | 1/2003 | Irwin | |
| 6,606,811 | B1 | 8/2003 | Olson | |
| 6,608,811 | B1 | 8/2003 | Holden et al. | |
| 6,722,253 | B2 | 4/2004 | Johnson | |
| 6,763,755 | B2 | 7/2004 | Johnson | |
| 6,851,346 | B1 | 2/2005 | Herring | |
| 6,871,437 | B1 | 3/2005 | Bartozzi et al. | |
| 6,901,837 | B2 | 6/2005 | Johnson | |
| 7,219,462 | B2 | 5/2007 | Finn | |
| 7,261,029 | B1 | 8/2007 | Davis | |
| 7,364,057 | B2 | 4/2008 | Carroll | |
| 7,497,044 | B2 | 3/2009 | Cammenga et al. | |
| 7,562,614 | B2 | 7/2009 | Polston | |
| 7,568,422 | B1 | 8/2009 | Barrett | |
| 7,661,219 | B1 | 2/2010 | Knight, Jr. et al. | |
| 7,753,679 | B1 * | 7/2010 | Schuetz | 434/16 |
| 7,823,312 | B2 | 11/2010 | Faifer | |
| 7,937,872 | B1 | 5/2011 | Fluhr | |
| 8,015,742 | B2 | 9/2011 | Zedrosser | |
| D652,468 | S | 1/2012 | Burt et al. | |
| 8,161,861 | B2 | 4/2012 | Haley et al. | |
| 8,261,652 | B2 | 9/2012 | Findlay | |
| 8,327,749 | B2 | 12/2012 | Underwood | |
| 8,356,439 | B2 * | 1/2013 | Dubois | 42/49.02 |
| 8,359,966 | B1 * | 1/2013 | Brotherton | 89/181 |
| 8,572,875 | B2 * | 11/2013 | Sisgold | 42/1.02 |
| 2003/0208940 | A1 | 11/2003 | Johnson | |
| 2003/0208941 | A1 * | 11/2003 | Johnson | 42/18 |
| 2004/0255766 | A1 | 12/2004 | Johnson | |
| 2005/0000138 | A1 | 1/2005 | Kiss | |
| 2005/0011345 | A1 | 1/2005 | Herring | |
| 2005/0115128 | A1 * | 6/2005 | Hahin | 42/50 |
| 2005/0183310 | A1 | 8/2005 | Finn | |
| 2008/0092733 | A1 | 4/2008 | Leitner-Wise et al. | |
| 2009/0288326 | A1 | 11/2009 | Twardy | |
| 2010/0162604 | A1 | 7/2010 | Dubois | |
| 2010/0251591 | A1 | 10/2010 | Burt et al. | |
| 2010/0275485 | A1 | 11/2010 | Findlay | |
| 2011/0056107 | A1 | 3/2011 | Underwood | |
| 2011/0078937 | A1 | 4/2011 | Rich | |
| 2011/0079132 | A1 | 4/2011 | Rich | |
| 2011/0107902 | A1 | 5/2011 | Quetschke et al. | |
| 2012/0144713 | A1 * | 6/2012 | Dubois | 42/50 |
| 2012/0167424 | A1 | 7/2012 | Gomez | |
| 2012/0167433 | A1 * | 7/2012 | Robbins et al. | 42/75.02 |
| 2012/0297656 | A1 * | 11/2012 | Langevin et al. | 42/16 |
| 2013/0014416 | A1 * | 1/2013 | Sisgold | 42/1.02 |
| 2013/0152442 | A1 * | 6/2013 | Underwood | 42/6 |

* cited by examiner

FIG. 3
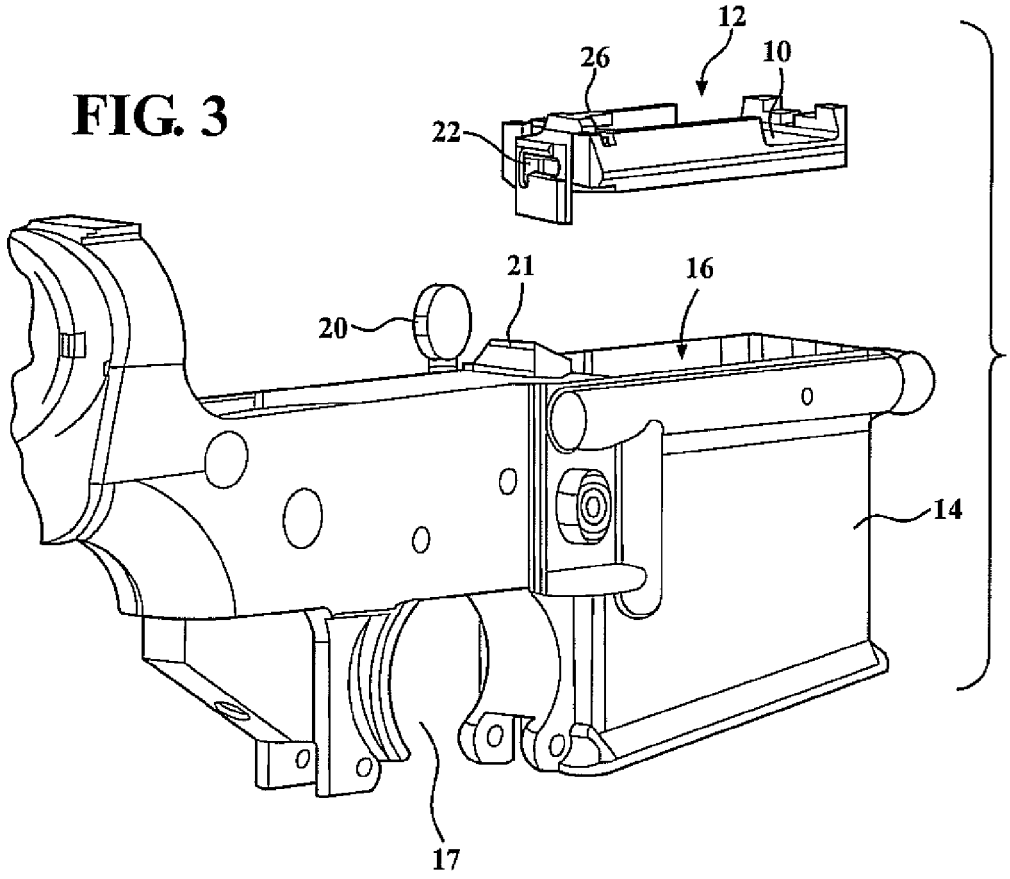
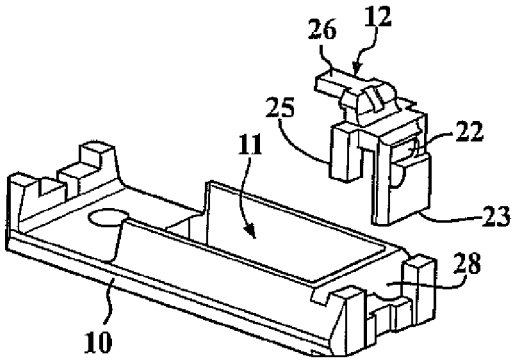
FIG. 4
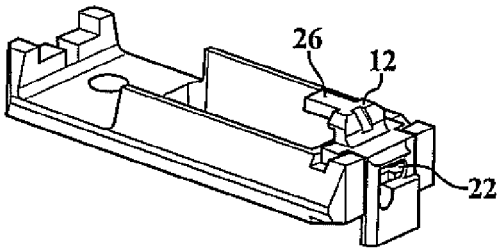
FIG. 5

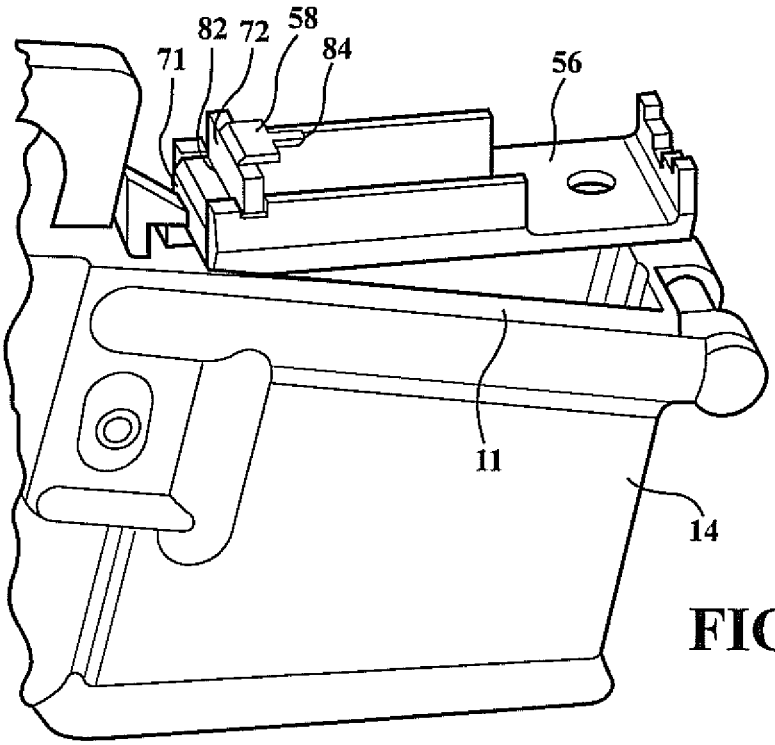
FIG. 11
FIG. 12
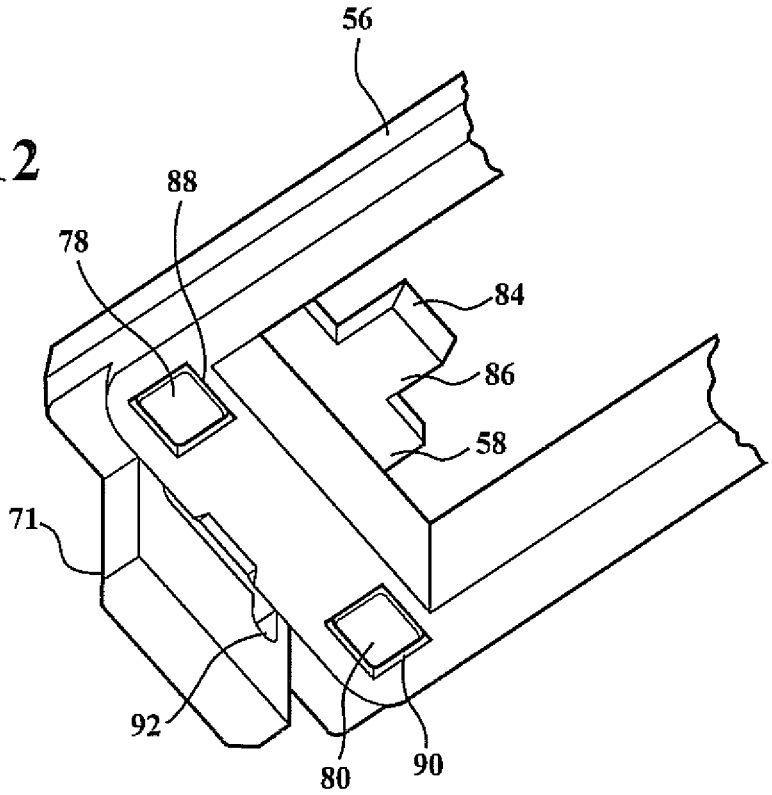

BOLT HOLD OPEN ACTUATOR FOR USE WITH AR-15/M16 TYPE FIREARMS

CROSS-REFERENCE TO RELATED APPLICATIONS

This Application is a Continuation-in-part of application Ser. No. 12/987,653 filed on Jan. 10, 2011. application Ser. No. 12/987,653 claims the benefit of U.S. Provisional Application 61/321,951 filed on Apr. 8, 2010.

FIELD OF THE INVENTION

The present invention relates generally to a bolt catch kit for establishing a last shot bolt hold open position. More specifically, the present invention teaches a bolt catch accessory fitting between upper and lower receiver assemblies associated with such as right or left handed AR-15 firearms, and which provides full function bolt hold open/release capabilities. The catch assembly is capable of functioning with rim fire conversion ammunition, and in particular any style of rim fire action firearm including but not limited to conversion and dedicated .22 kits. A further variant of the bolt hold open actuator operates without the requirement of a magazine follower, including the steps of retracting the bolt via the rear projecting charging handle, following which the bolt catch is toggled and the charging handle released in order to lift the actuator to lock the retracted bolt in the open position.

BACKGROUND OF THE INVENTION

The prior art is documented with examples of bolt catch mechanism, such as incorporated into AR-15/M-16 type firearms. One purpose of such bolt catch mechanisms is the ability to hold open a bolt or slide of a firearm firing mechanism in order to inspect the chamber after all rounds supplied by a magazine have been discharged. One known example of an ammunition magazine with internally supported and upwardly spring biased follower body is disclosed in Westrom, U.S. Pat. No. 5,638,626 and which discloses a bolt catch actuator coupled to the follower. The actuator is biasingly seated within the follower and further exhibits an actuation finger which, upon aligning the follower with a notch indicative of a last shot being fired, projects the finger through the notch in order to contact the bolt catch and restrain the reciprocating bolt in the open position.

SUMMARY OF THE INVENTION

The present invention discloses a bolt catch assembly for use with a firearm including a receiver with an exposed receiving chamber. The assembly includes a bolt catch actuator housing supported in (drop in or otherwise) seating fashion relative to the receiving chamber and communicating with an attachable magazine. A catch actuator is supported in elevatable fashion relative to an end of the actuator housing.

A bolt catch component and integrally formed actuator catch engaging portion is slaved to the catch actuator in order to be displaced in response to elevating motion exerted upon the catch actuator, such as by a follower component biasingly disposed within the magazine. The follower, in its uppermost displaced position within the attached magazine, engages a tab associated with the catch actuator which extends over a communicating interior of the bolt catch actuator housing in communicating alignment with the exposed receiving chamber. An end configured location of the bolt hold open actuator housing includes a step and ledge profile for supporting an underside of the catch actuator in each of a seated rest position as well as a follower induced and upwardly displaced position.

In a further variant, the bolt hold open actuator is utilized in combination with the charging handle for retracting the bolt. Alternative to the attached magazine with upwardly displaceable follower, the externally actuating bolt catch integrated into the lower receiver is toggled following charging handle induced retraction of the bolt and so that, upon releasing the charging handle, the conventional bolt catch acts upon an underside location of the upwardly displaceable catch portion associated with the bolt hold open actuator body and in order to elevate the catch portion to an upper position in which it both engages and restrains reverse travel of the retracted bolt. In this fashion, the bolt is maintained in the hold open position this without the necessity of the magazine attached and/or its upwardly displaceable follower engaging the elevatable bolt catch.

BRIEF DESCRIPTION OF THE DRAWINGS

Reference will now be made to the attached drawings, when read in combination with the following detailed description, wherein like reference numerals refer to like parts throughout the several views, and in which:

FIG. 3 is a rotated and partially exploded perspective illustrating the bolt catch actuator and actuator housing;

FIG. 4 is an enlarged and exploded perspective of the bolt catch actuator and actuator housing depicted in FIG. 3;

FIG. 5 is an assembled view of the bolt actuator assembly;

FIG. 11 is a partial perspective of a bolt hold open actuator body according to a slightly modified variant and depicted in an intermediate assembled position relative to an upper support rim of the lower receiving housing, this defining and open interior communicating the bolt action assembly with the optional underside attachable magazine and follower;

FIG. 12 is an underside rotated and partial perspective of the bolt hold open actuator body in combination with the structural elevating portion for displacing the upper bolt catch portio and depicting from another angle it rearward most and downward extending profile for facilitating engagement by the conventional and externally configured bolt catch;

DETAILED DESCRIPTION OF THE PREFERRED EMBODIMENTS

Referring now to the several illustrations, the present invention teaches a bolt catch accessory installed between upper and lower receiver assemblies associated with any suitable firearm but in one applicable variant to any of a related family of M-16 or AR-15 firearms. The invention in particular discloses a bolt catch actuator housing supported in any desired fashion not limited to a drop in style housing within an upper exposed rim of a lower receiver housing chamber and which includes an end supported and elevatable bolt catch actuator for in turn engaging a conventional bolt catch component associated with a reciprocating bolt of the firearm.

Figure 6A:
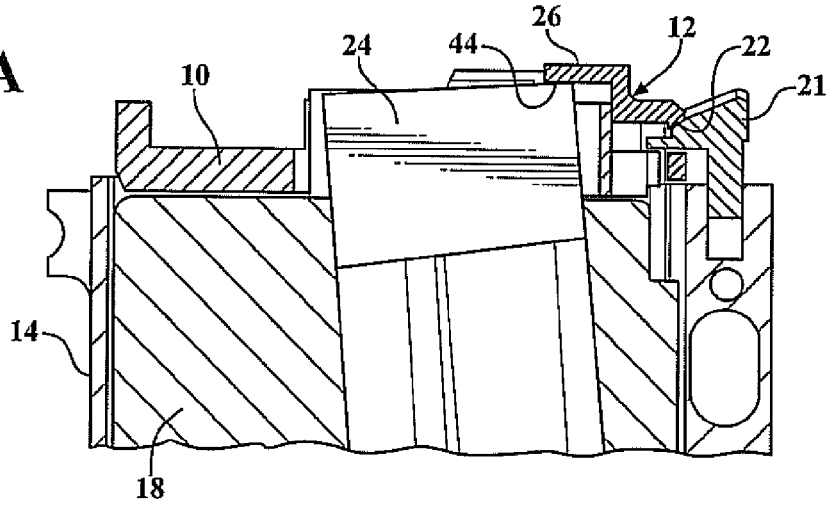
FIG. 6A is a side cutaway sectional view depicting the bolt catch assembly installed upon the lower receiver, with the magazine inserted and showing the bolt catch in an engaged position by the bolt catch actuator.
Figure 6B:
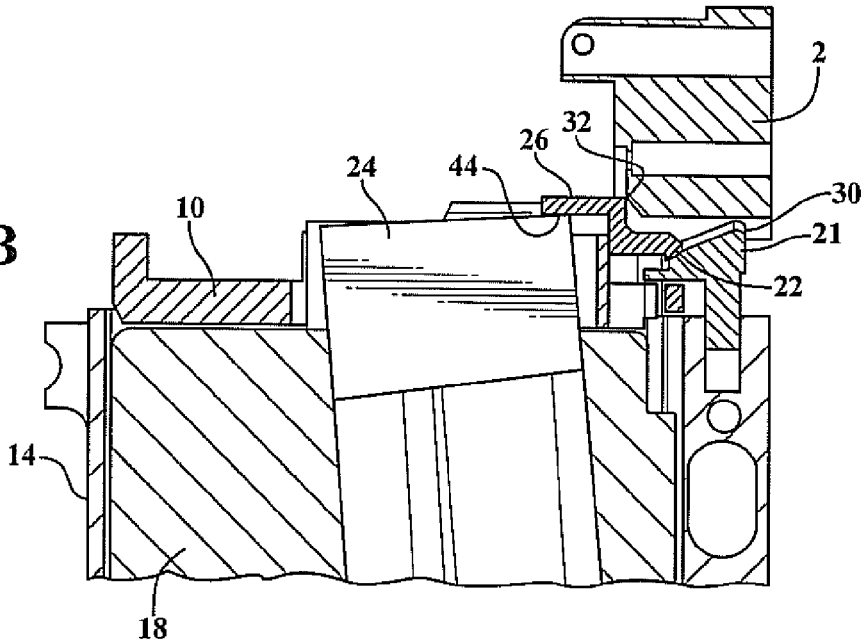
FIG. 6B is a succeeding illustration depicting the upwardly biasing bolt catch actuator likewise upwardly translating the bolt catch in an obstructing position to a reciprocating bolt.

The bolt catch assembly (in use with reciprocating bolt 2 representatively depicted in FIG. 6B) is defined by a drop in actuator housing 10 and a supported and elevate-able bolt catch portion 12. In one non-limiting application, the assembly is particularly configured for operating with rim fire ammunition (as opposed to center fire ammunition in which the firing pin strikes a primer cap at the center of a base of the cartridge). As is further known, rim fire ammunition includes a widened base rim which is essentially a widened percussion cap containing the desired priming compound, while the associated cartridge case itself contains the propellant powder and projectile (bullet).

Figure 1:
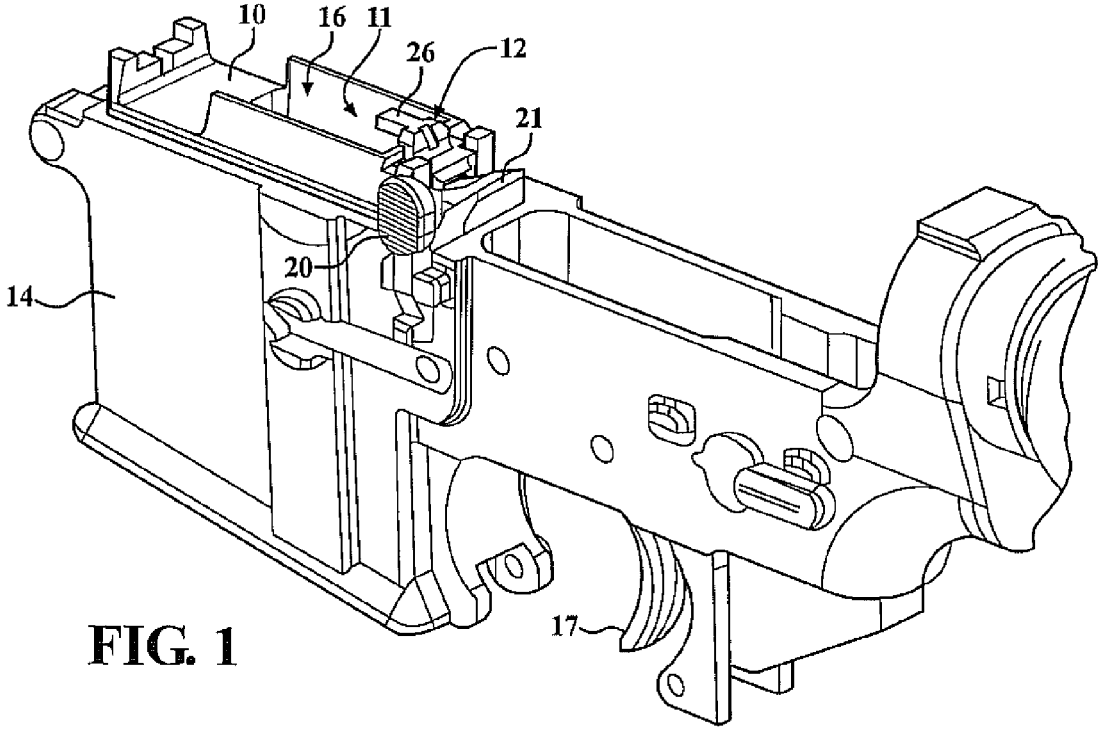
FIG. 1 is a sectional perspective of a lower receiver with exposed receiving chamber for communicating with an attachable magazine and within which is drop installed the bolt catch actuator.

Referring to FIG. 1, a sectional perspective is shown of a lower receiver 14 with exposed receiving chamber 16 in proximate location to a trigger assembly exhibited by an exposed trigger 17. The bolt catch actuator housing 10 is not limited to any particular configuration however, and in the variant shown, exhibits a generally four sided rectangular configuration with an open interior, defined by inner perimeter wall 11.

Figure 2:
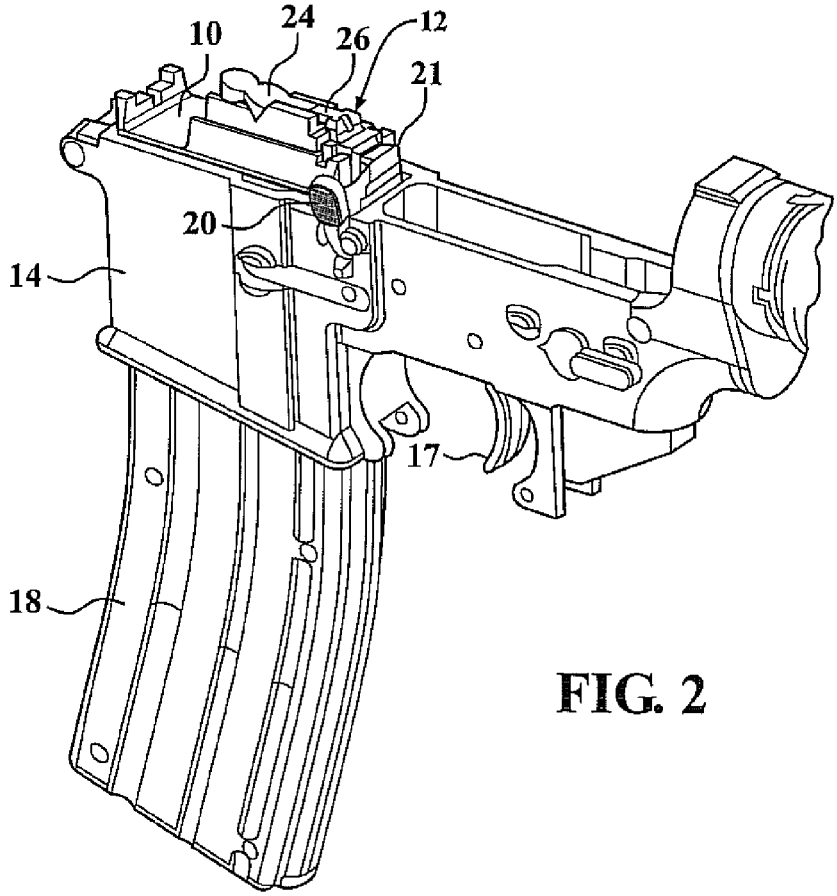
FIG. 2 is a related sectional perspective and further illustrating the magazine engaged to the open underside of the lower receiver chamber.

The housing 10 is dimensioned for drop in seating relative to an upper communicating surface of the receiver surrounding the receiving chamber 16 and such that the inner perimeter wall 11 defining open interior communicates with both the open receiving chamber 16 and with underside attachable magazine 18 (FIG. 2). As further described below, the elevateable bolt catch portion 12 is vertically displaceably supported at an end of the housing 10 in communication with its perimeter defined interior.

The lower receiver further includes a bolt catch, this being typically built into the receiver and illustrated by a user engageable (thumb actuated) portion 20 which in turn vertically actuates in one manual operation an integrally formed catch 21 which is further shown in communication with a forward end of the receiver chamber. As best depicted in each of FIGS. 6A-6C, the bolt catch 21 exhibits a narrowed taper seated within an open configured window 22 of the catch actuator 12 (see also FIG. 4) in order to be displaced in slaved fashion responsive to elevating motion exerted upon the bolt catch portion 12, such as by a follower component (see at 24 in FIG. 2) biasingly disposed within the magazine 18 by a spring underneath a last of a plurality of cartridges (not shown) which are progressively discharged by virtue of the reciprocating bolt action of the firearm operation.

The follower 24 is an existing internal component of the magazine 18 and, in its uppermost displaced position within the attached magazine as depicted in FIG. 2, engages an overhanging tab portion 26 of the bolt catch portion 12 which extends over the communicating interior of the bolt catch actuator housing 11 and in communicating alignment with the exposed receiving chamber 16 (see also FIG. 6B). As further best shown in the exploded view of FIG. 4, a supporting end of the bolt catch housing 10 is exhibited by an end configured location 28 including a step and ledge profile (see spaced apart legs 23 and 25 associated with the catch actuator 12 which straddle the end location 28) and which enables the underside of the bolt catch portion 12 to be supported in each of a seated rest position (FIG. 6C) as well as follower induced and upwardly displaced position (FIG. 6B).

Further variants of the invention contemplate use of the bolt catch actuator housing 10, without the associated and vertically displaceable bolt catch portion 12. This can occur in situations where other rim fire type cartridges are employed and where it is desired to employ the actuator housing 10 alone in order to provide for a tighter fit with the upper engaging end of the magazine 18.

As previously described, FIG. 6A is a side cutaway sectional view depicting the bolt catch housing 10 installed upon the lower receiver 14 and with the magazine 18 inserted and showing the bolt catch 21 engaging the bolt catch portion 12. As further depicted in FIG. 6B, the upwardly biasing bolt catch portion 12 (again resulting from a spring induced elevation of the follower component 24 supported within the magazine engaging the overhead extending tab portion 26) likewise upwardly translates the catch 21 integrated into the component including the externally mounted thumb actuated portion 20 (slaved to the bolt catch portion 12 again by the seating window defined by the inner edge profile 22) in an obstructing position relative the reciprocating bolt 2 as further depicted by abutting location 30 (again FIG. 6B) and which is additional to a secondary abutting location 32 established between the tab 26 and a further location of the bolt 2.

As is known, the bolt 2 is a mechanical part of the firearm which blocks a rear of the associated chamber during burning of the propellant. In semi-automatic firearms, such as is the case AR-15 type firearms, the bolt is caused to cycle back and forth during each cartridge discharge cycle, propelled by recoil/expanding gas (backwards) or spring recoil (forwards). Upon moving back, an elongated lug disposed upon a bottom of the reciprocating bolt strips the cartridge casing (also not shown) from the magazine 18 and pushes it into the firearm chamber (see FIG. 1). Upon discharge, and once the spent shell casing case is clear of the chamber, an ejector component (also not shown but understood to also include an integral component of the bolt along with the firing pin), ejects the casing from the receiver and out of the firearm. As finally shown in FIG. 6C, the elevate-able bolt catch portion 12 is depressed by the externally actuated bolt catch 21, such as to release the bolt 2.

In this fashion, the bolt catch kit functions to retain the bolt 2 in a hold open position (again FIG. 6B) following discharge of a last cartridge and upward displacement of the follower 24 into contact with the catch actuator 12 and slaved catch 21, again via window 22 defined in the actuator 12 within which the catch 21 is seated. In this fashion, the bolt 2 is caused to remain open upon removal of the magazine 18 with selective release capability.

Referring finally to each of FIGS. 7 and 7A-7E, a series of perspective, plan and exploded views are successively depicted of a modification of bolt catch actuator housing 34 and which is largely similar to that previously depicted at 10. The housing 34 likewise exhibits a generally elongated configuration and with a rectangular inwardly facing closed perimeter 36 defining an internal opening which communicates with the receiver chamber 16. An adjustable screw 38 (illustrated in each of FIGS. 7C, 7D and 7E) is incorporated into a bottom end location of the housing 34, see also internally threaded aperture 40 in FIG. 7E, such that rotative displacement of the screw 38 results in contact with and vertical displacement of an underside abutting location associated with a support structure 42 of a catch actuator 44 and for vertically raising and lowering the catch actuator 44 to an optimal height location, such as to remove and residual slack or play in the actuator, and in order to ensure that the bolt catch 21 does not interfere with reciprocating bolt operation until a last round within the magazine is discharged.

Figure 7:
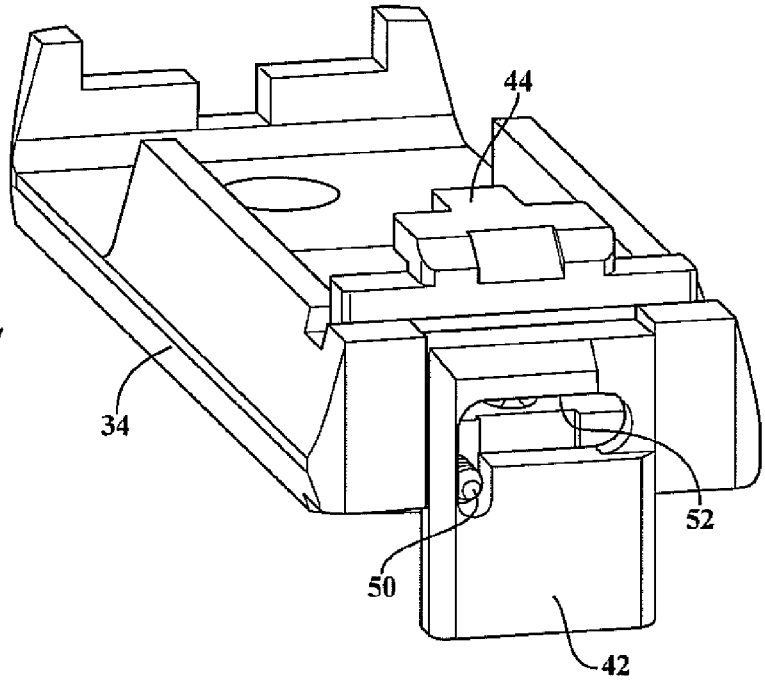
FIGS. 7 and 7A-7E present a variety of perspective, plan and exploded view of the modified actuator housing depicted in FIG. 5 and further illustrating the feature of the bottom adjustable screw for vertically raising and lowering the catch actuator to an optimal height location, such as to remove and residual slack or play in the actuator, and in order to ensure that the bolt catch does not interfere with reciprocating bolt operation until a last round within the magazine is discharged.
Figure 7A:
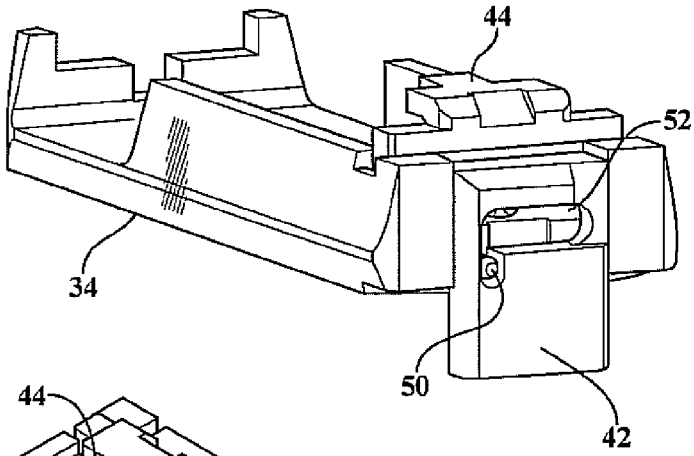
Figure 7B:
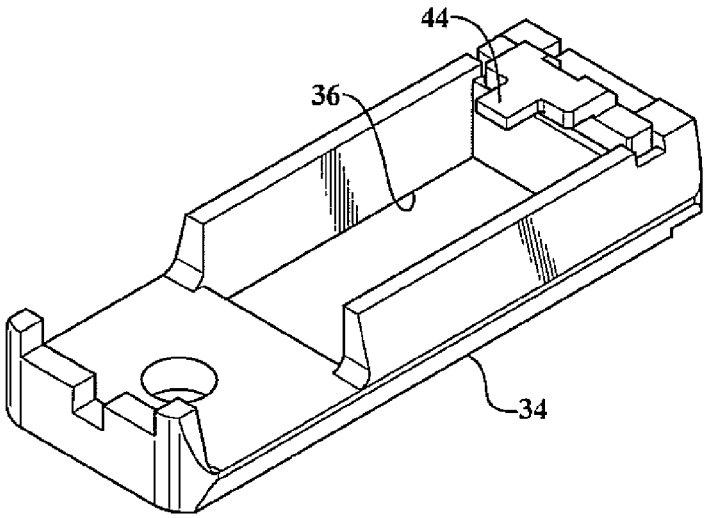
Figure 7C:
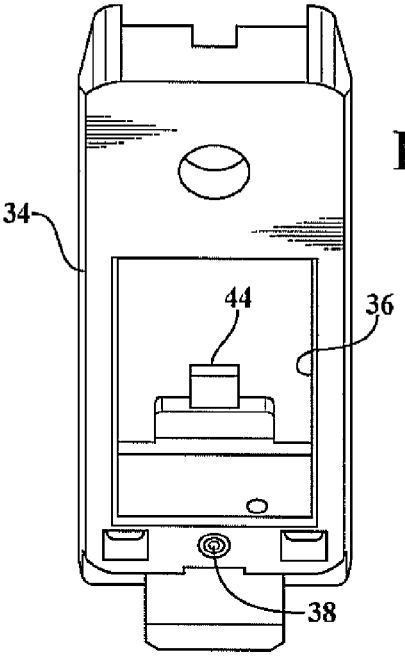
Figure 7D:
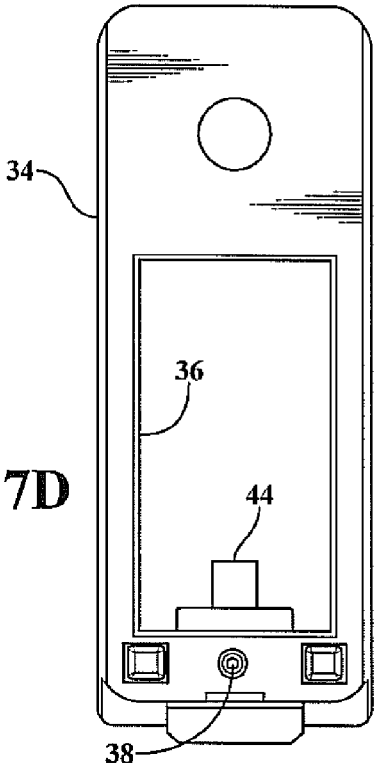
Figure 7E:
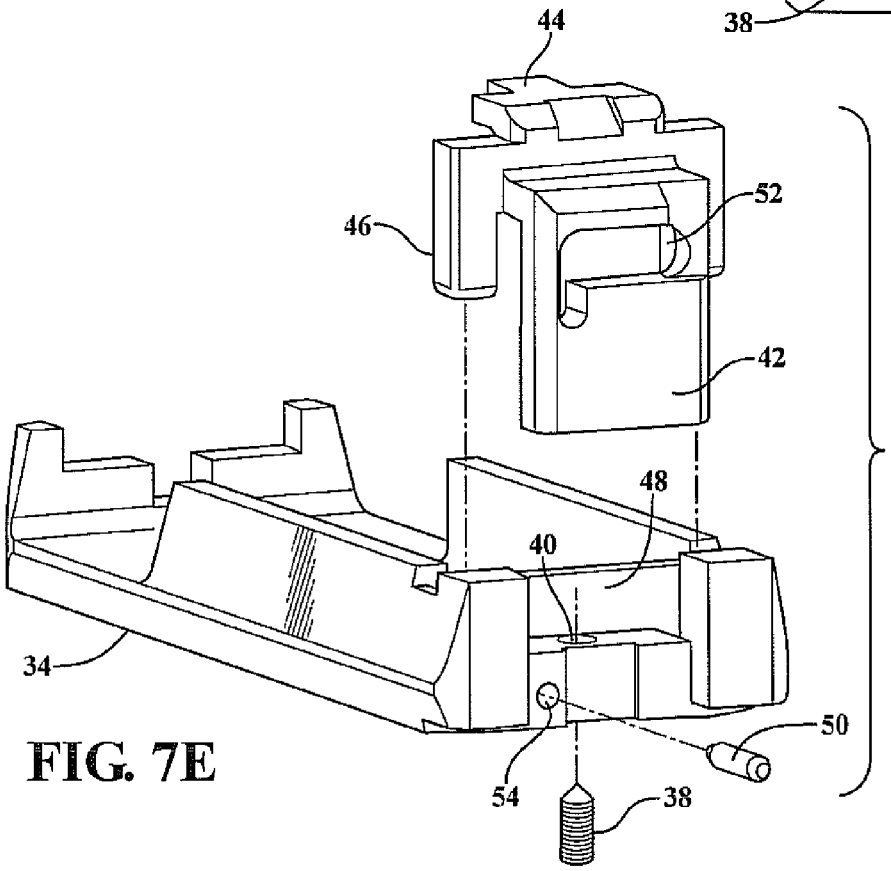

Additional features also depicted in the earlier variant 12 of the catch actuator again include a further pair of inwardly spaced legs or tabs 46 (FIG. 7E) relative to the outer support structure 42 in order to support the catch actuator 44 upon an edge defined surface 48 (again FIG. 7E) of the housing 34. A secondary locating pin 50 is installed horizontally through a slot 52 (as best shown in FIG. 7) and engaged through a further aperture 54 (FIG. 7E) in order to define a range of vertical motion of the catch actuator as defined by the vertical component of the slot 52 in the support structure 42. In operation, the interface between the follower assembly 24 and the bolt catch portion 12 and supporting drop in acuator housing 10 operate to provide a last shot bolt open condition, such as in conjunction with a rimfire style ammunition which varies the engagement structure established between the firearm configured bolt catch 18/20 and shell base.

Referring now collectively to FIGS. 8-18, a collection of perspective, cutaway and sectional views are shown of a second variant of the present invention for achieving a hold open condition associated with the reciprocating bolt and in which the bolt hold open actuator with vertically displaceable catch portion is utilized without the requirement of the magazine and/or its vertically displaceable follower body. Without limitation, it is understood that the bolt hold open actuator with its end located and vertically elevate-able catch portion is capable of being utilized either in combination with a magazine and follower (as previously depicted in FIGS. 1-7) or with the magazine and/or follow remover (such as hereinafter described and illustrated and which is not limited to application in a single chambered cartridge shot capacity). In this latter application, an operator initiated protocol (as will be also described in further detail) is employed with the charging handle initially being engaged for retracting the bolt, this in combination with the externally accessible bolt catch being subsequently manipulated in order to elevate the internally supported catch portion (this again occurring without the upwardly influencing effect of the magazine supported follower) for abutting and preventing reverse/forward return of the bolt upon user release of the charging handle, and to thereby utilize the bolt hold open actuator in a further non-follower inducing variant for retaining the hold open condition.

Figure 8:
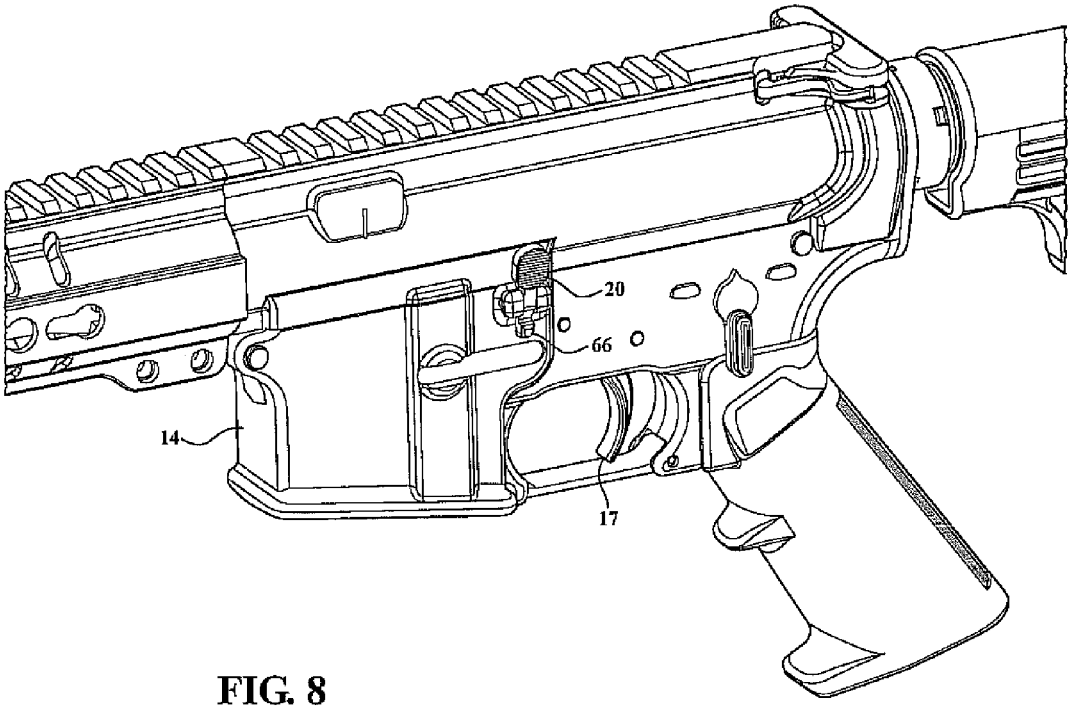
FIG. 8 is an illustration in perspective of an AR-15 style firearm with a magazine and associated follower removed.
Figure 9:
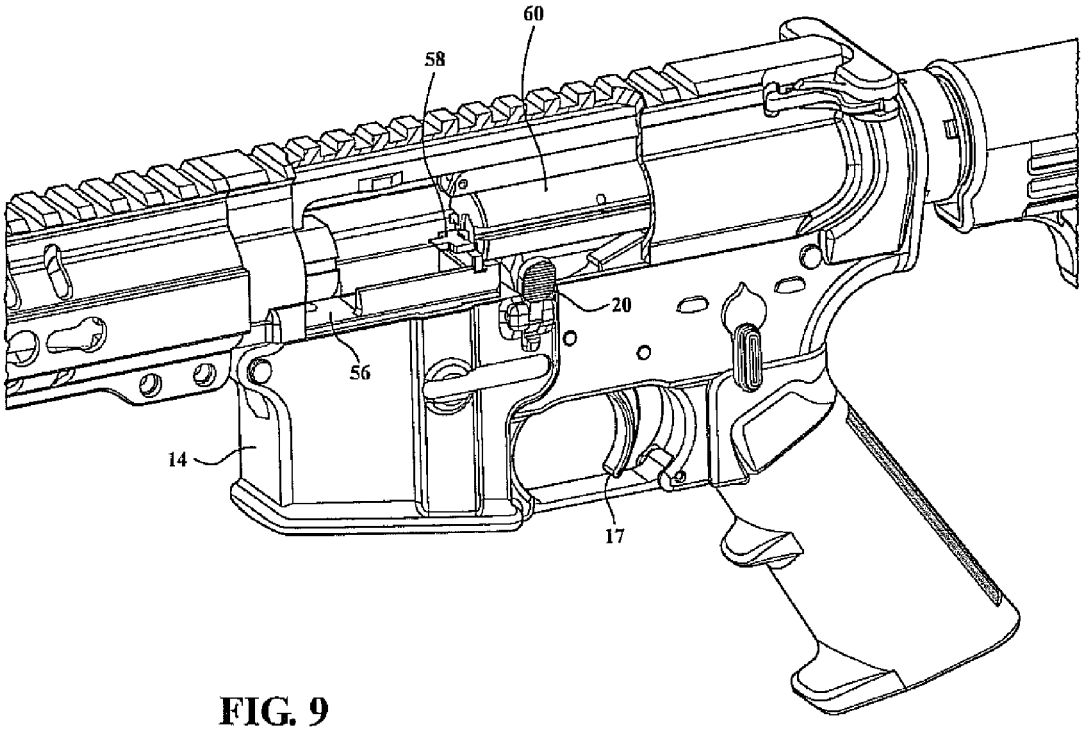
FIG. 9 is an illustration similar to FIG. 8 in partial cutaway in order to reveal the bolt, bolt catch and drop in bolt hold open actuator body with vertically displaceable catch portion.

Referring first to FIG. 8 is an illustration is depicted in perspective of an AR-15 style firearm similar to that previously depicted and with its magazine (at 18 in FIG. 2) and associated follower (further at 24 in FIGS. 6A-6C) removed. FIG. 9 is an illustration similar to FIG. 8 in partial cutaway in order to reveal a bolt hold open actuator (BHOA) body 56 with vertically extensible catch portion 58 seated in drop in fashion within the perimeter surrounding rim 11 (FIG. 1) defining the receiving chamber 16. Reciprocating bolt 60 is further depicted in a retracted and abutting position with a rear location of the BHOA catch portion 58.

Figure 10:
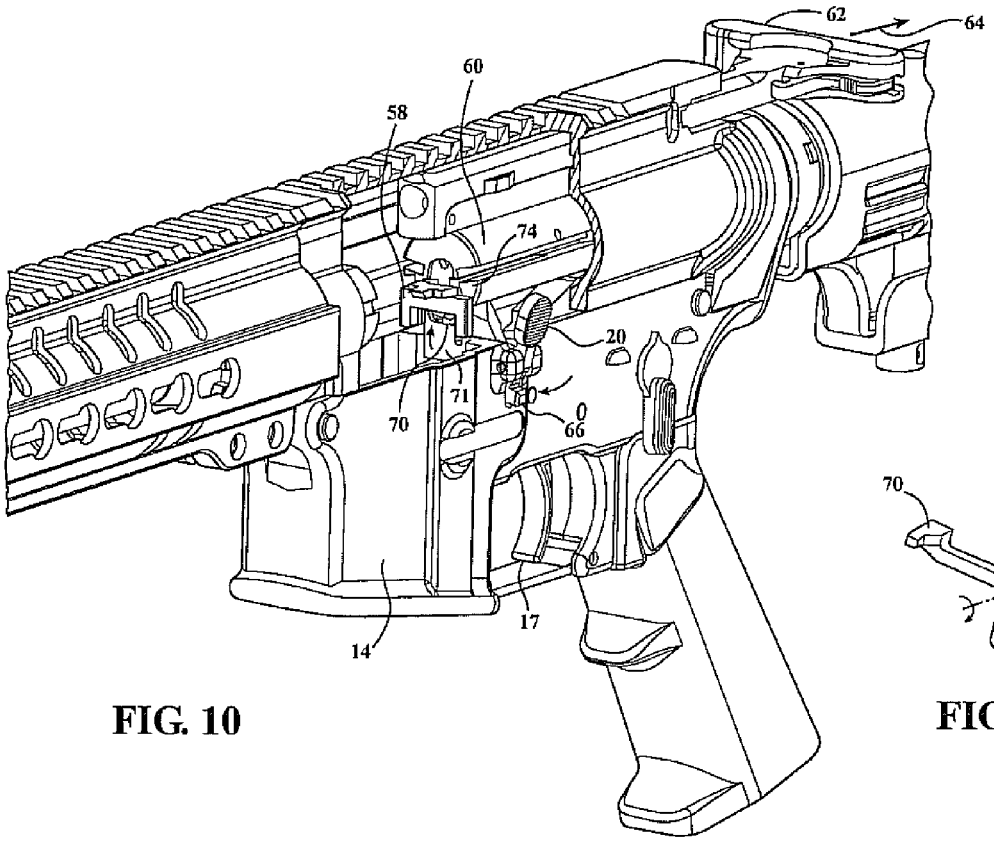
FIG. 10 is a succeeding illustration to FIG. 9 and which further shows the operational protocol according to the further embodiment for retracting the bolt and elevating the catch portion of the drop in actuator body in order to restrain return forward travel of the bolt.

As shown in FIG. 10, which is a succeeding illustration to FIG. 9, one non-limiting example is depicted of an operational protocol for retracting the bolt 60 and elevating the catch portion 58 of the drop in actuator body 56 in order to restrain return forward travel of the bolt 60, thereby retaining it in the hold open position. This includes the operator grasping and rearwardly retracting the charging handle 62 in the direction depicted by arrow 64. As is known, the interior extending end of the charging handle is slaved to a contact location with the bolt 60 such this its retracting is transferred to the spring loaded bolt which is in turn actuated in a retracting direction relative to its supporting receiver plate (not shown) or other supporting structure associated with the action assembly within which the reciprocating bolt is contained.

Figure 10A:
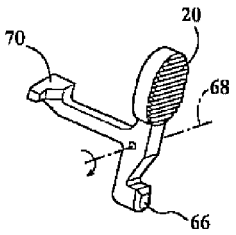
FIG. 10A is a separate view of the pivotally supported bolt catch with inner extending portion for elevating the catch portion as shown in FIG. 10.

At this point, the conventional and externally mounted bolt catch is activated, such as by depressing the lower situated toggle portion 66 which is located on an opposite pivot location (see pivot point 68 in FIG. 10A) relative to the upper thumb actuated portion 20. Toggling of the portion 66 in the manner indicated results in a configured end location of the bolt catch, at 70, pivoting up into contact with an aperture receiving location defined within a rear most and downwardly extending support 71 of the vertically displaceable bolt catch 58 (a more detailed description of which is had with subsequent reference to FIGS. 11-18).

At this point the charging handle 62 is released and a configured edge 72 of the bolt catch 58 (see FIG. 11) is caused to be abutted by a front end face 74 of the bolt (FIG. 10) to thereby establish an exposable condition associated with an opening in the upper receiver receiver housing and for the user to visually confirm that a last shot has been filed and that the bolt 60 is retracted to the open position. Release of the bolt 60 (thereby permitting it to slide forwardly to close the action assembly) can be accomplished by again retracting the charging handle 62 so as to relieve the spring pressure of the bolt 60 applied to the elevate-able catch portion 58, following which the conventional bolt catch is reverse toggled (by depressing thumb portion 20) thereby causing the end 70 to reverse pivot downwardly, thereby lowering the bolt catch portion 58 by virtue of the support 71 being displaced downwardly. Alternatively, release of the bolt 60 can be accomplished by retracting and releasing the charging handle 62 alternately to pressing the bolt catch 70, the construction of the upper receiver allowing for either action in completely forward bolt release.

With reference to the above description, it is understood that the bolt hold open actuator components according to each of the variants 10 (FIGS. 1-7E) and 56 (FIG. 9 et seq.) depicted herein can be modified in any manner desired, such as by varying the construction of the vertically displaceable catch portion associated with the main (drop in) actuator body and for use with any suitable firearm and with or without use of a magazine with associated follower. As described previously, the BHOA 10 or 54 enables bolt catch functionality as well as last round hold open (when used with a suitable magazine with follower) as well as typically a shorter bolt catch spring (not shown).

The above said, FIGS. 11-18 present a series of additional illustrations referencing the bolt hold open actuator (BHOA) 56 according to one non-limiting version and which again includes a drop-in construction for placement over the open rim 11 of the lower receiver 14 for accessing the interior receiving chamber 16. The variants of BHOA depicted and described herein are understood to be securely retained in place over the lower receiver rim 11 upon installation of the remaining components of the upper receiver (including the housing previously illustrated in FIGS. 8-10 for receiving the bolt 60 and supporting action assembly, the forward assist, and the attachable barrel). It is also understood that any suitable reconfiguration of a suitable BHOA adaptor (such as again for facilitating conversion to a .22 rim fire cartridge) can envision any of a variety of differing shapes and engagement profiles for securing to the lower receiver upper rim 11, such as beyond the drop-in variant depicted.

Figure 6C:
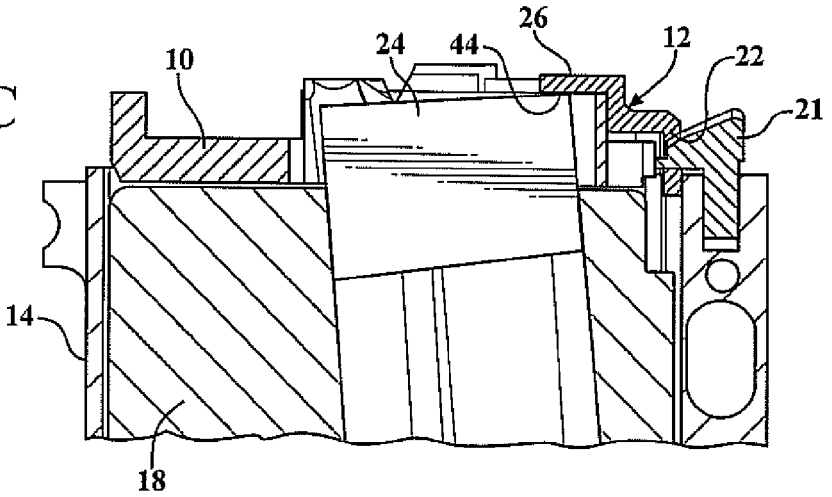
FIG. 6C illustrates a further position in which the bolt catch actuator is depressed by the bolt catch, such as to release the bolt.

The above said, FIG. 11 is a partial perspective of the bolt hold open actuator body 56 depicted in an intermediate assembled position relative to the upper support rim of the lower receiving housing 14, this defining and open interior communicating the bolt action assembly with the optional underside attachable magazine and follower, such as further depicted in non-limiting variant of FIGS. 6A-6C.

FIG. 12 is an underside rotated and partial perspective of the bolt hold open actuator body 56 in combination with the elevating structural portion previously referenced at 71 and depicting, from another angle, its rearward and downward extending profile. Also shown at 78 and 80 are bottom ends of a pair of spaced apart legs associated with a substantially inverted "U" shaped portion of the bolt catch 58. The "U" shaped portion (as also viewed from the subsequent illustrations) is anchored along interconnecting edge 82 (see again FIG. 11) to the downward structural portion 71, in order to be integrally joined to the bolt catch 58 and so that ascending/descending motion influenced upon the catch 58 (whether from the conventional bolt catch end 70 pivoting the structural portion 71 or from the magazine follower engaging the underside edge profile 84 of the inner extending and overhanging tab 86) facilitates smooth ascending or descending motion. This is further assisted by apertures 88 and 90 defined in the associated end of the BHOA body 56 which receive the inverted legs 78 and 80 and which, in combination with a vertical slot 92 defined the structural portion 71 (see as best shown in the inverted view of FIG. 13) defines a range of up/down motion for the catch portion 58 as permitted by a pin 94 anchored to the opposing end face of the body 56 and seated within the slot 92.

Figure 13:
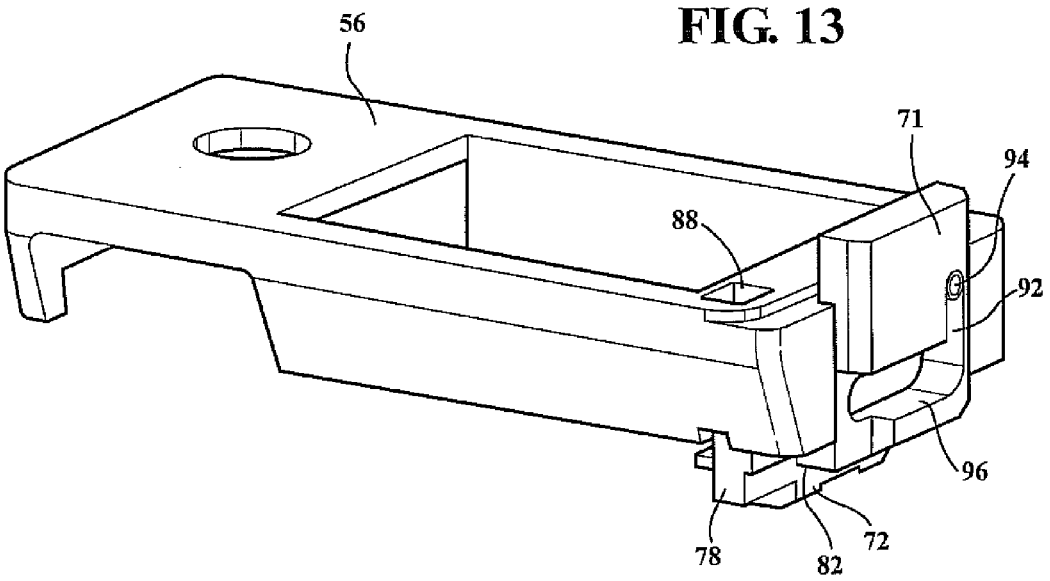
FIG. 13 is a further rotated and inverted perspective of the drop in bolt hold open actuator according to the embodiment of FIG. 9 et seq. and which illustrates from another angle the architecture of the elevatable catch portion.

As further shown in FIG. 13, an associated horizontal interconnecting component 96 (as with vertical component 92 being defined by an inner extending rim edge) establishes a pseudo "L" shaped aperture within the rearmost and downward extending structural portion 71. As further best seen in FIG. 10, the pivoting end 70 of the toggled and spring loaded bolt catch (opposing locations 20 and 66) engages the structural portion 71 through a horizontal location of the slot 96, thereby facilitating smooth ascent/descent of the upper configured locations of the BHOA catch portion 58, this again due to the balancing properties afforded by the inverted legs 78 and 80 as guided by the receiving apertures 88 and 90.

Figure 14:
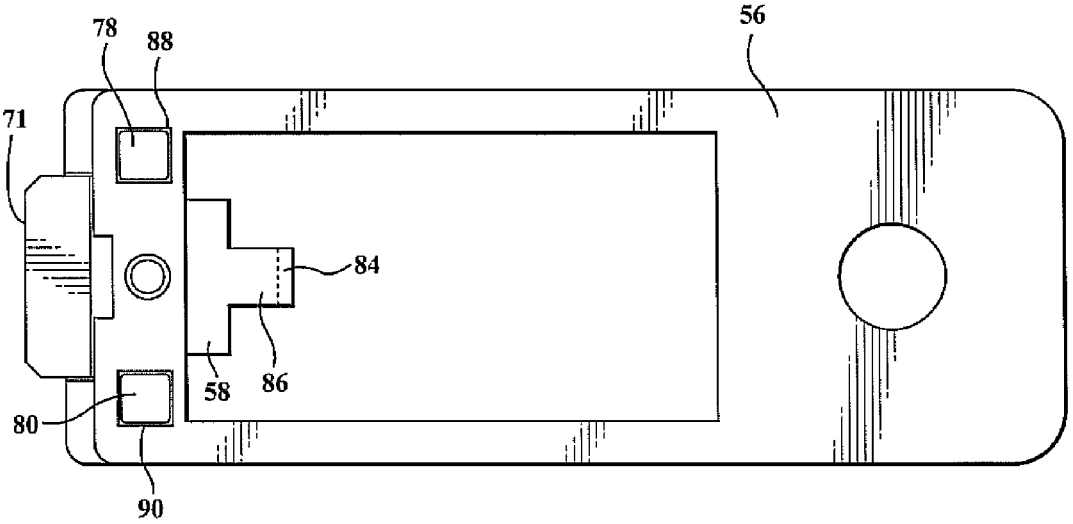
FIG. 14 is a further rotated underside inverted plan view of the bolt hold open actuator depicting the inwardly spaced pair of legs associated with the "U" shaped component for seating within end proximate apertures of the actuator, this in order facilitate smooth transfer of the upwardly displacing motion induced upon the rearward leg (by the catch portion) to in turn elevate the catch portion of the BHOA, and which is further illustrated by the interiorly extending and overhanging tab portion associated with the open interior of the drop in actuator.

FIG. 14 is a further rotated underside inverted plan view of the bolt hold open actuator again depicting the inwardly spaced pair of (inverted) legs 78 and 80 associated with the "U" shaped component for seating within end proximate apertures 88 and 90 of the actuator body 56, this again in order facilitate smooth transfer of the upwardly displacing motion induced upon the rearward leg (by the catch portion) to in turn elevate the catch portion 58 of the BHOA, and which is further illustrated by the interiorly extending and overhanging tab portion 86 associated with the open interior of the drop in actuator.

Figure 15:
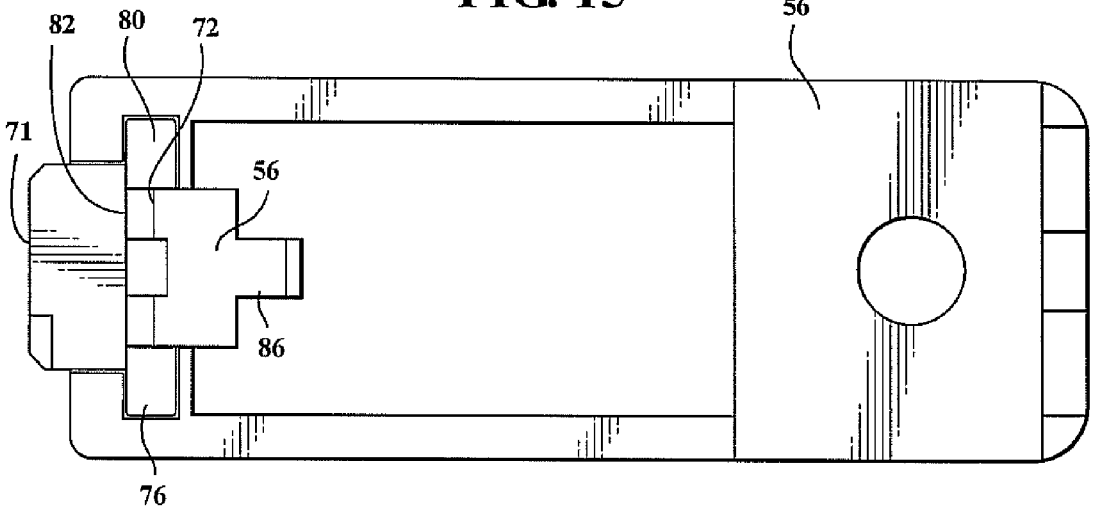
FIG. 15 is a rotated top plan view of the bolt hold open actuator depicted in FIG. 14 and illustrating the bolt catch portion from another direction.
Figure 16:
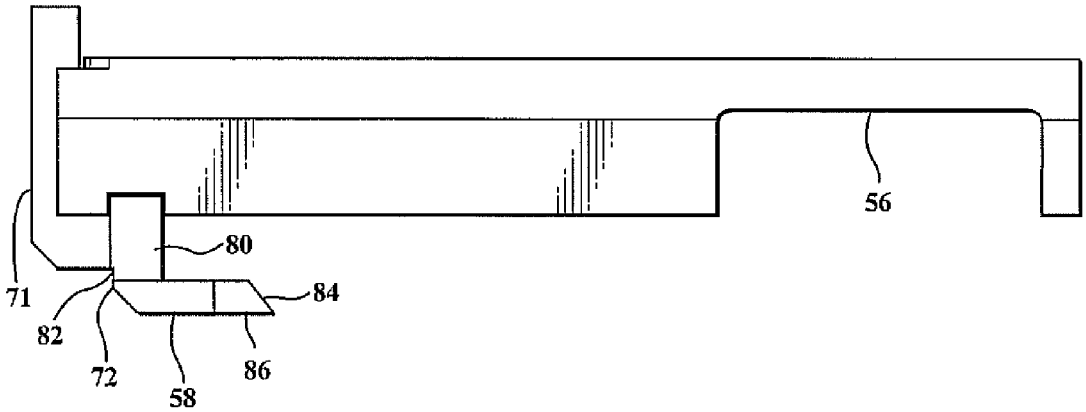
FIG. 16 is an inverted side profile of the bolt hold open actuator depicting the catch portion from another vantage.

FIG. 15 is a rotated top plan view of the bolt hold open actuator depicted in FIG. 14 and illustrating the bolt catch portion 58 from another direction. FIG. 16 is an inverted side profile of the bolt hold open actuator depicting the catch portion from another vantage.

Figure 17:
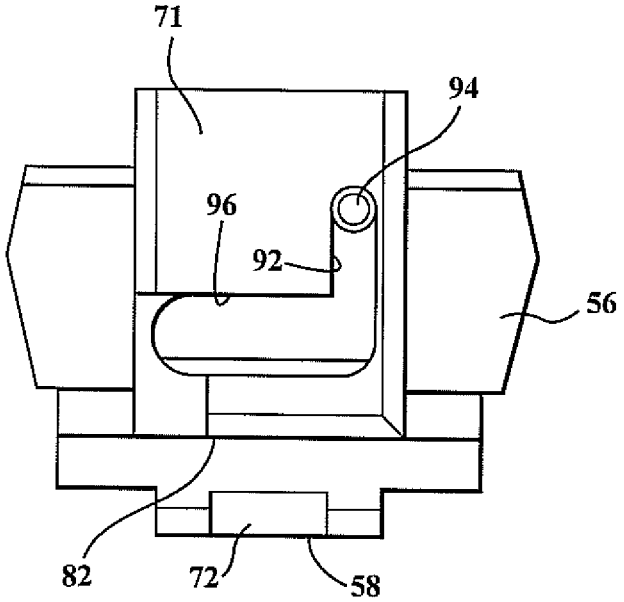
FIG. 17 is a first inverted end view of the bolt hold open actuator depicting the range of vertical elevation associated with the pin and slot configuration defined in the interior of the rearward most and downwardly extending leg.
Figure 18:
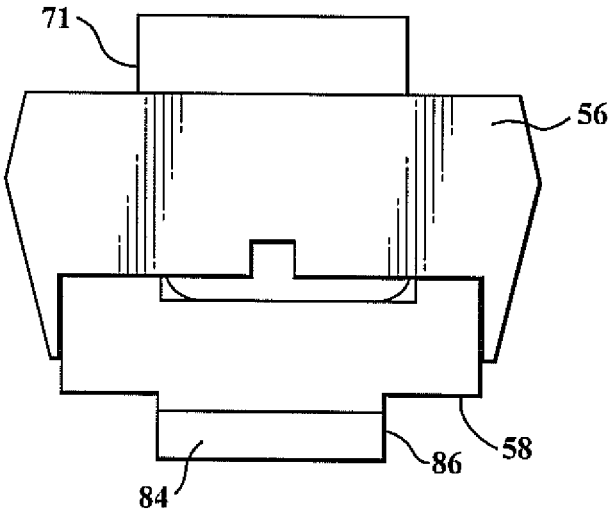
FIG. 18 is an opposite inverted end view of the bolt hold open actuator.

FIG. 17 is a first inverted end view of the bolt hold open actuator depicting the range of vertical elevation associated with the pin and slot configuration as reflected in FIG. 13 and defined in the interior of the rearward most and downwardly extending structural leg or portion 71. Finally, FIG. 18 is an opposite inverted end view of the bolt hold open actuator as depicted herein.

Having described my invention, other and additional preferred embodiments will become apparent to those skilled in the art to which it pertains, and without deviating from the scope of the appended claims.

We claim:

1. An actuator for establishing a bolt hold open condition in use with a firearm; said actuator comprising:

a body having a perimeter including sides, a first end, and a second end, and the body exhibiting a perimeter defined open interior and the body being sized to seat upon an upper surface of a receiver of a receiver firearm and in proximity to an exposable location of an inner chamber of said firearm; and an actuator bolt catch supported relative to said first end of said body and being shaped to be displaceable in a direction generally parallel relative to a passage direction of the perimeter defined open interior, and the actuator bolt catch having have a face shaped to be engaged by a firearm bolt catch.

2. The actuator as described in claim 1, said actuator bolt catch further comprising a rearward and downward extending structural portion, wherein downward is relative to the actuator bolt catch not in a bolt hold open condition and rearward is relative to the first end.

3. The actuator as described in claim 2, said body further defining a pair of spaced apart apertures, and said actuator bolt catch further comprising an inverted "U" shaped element containing a pair of downwardly extending legs which each seat within one of said spaced apart apertures and that are each integrally joined with said rearward and downward extending structural portion.

4. The actuator as described in claim 2, said rearward and downward extending structural portion defining a slot in said actuator bolt catch.

5. The actuator as described in claim 1, said actuator bolt catch further comprising a tab extending above said open interior of said body.

6. The actuator as described in claim 1, said body further comprising a generally rectangular shape.

7. The actuator as described in claim 1, further comprising a support structure.

8. The actuator as described in claim 7, wherein said actuator bolt catch is shaped to include said support structure.

9. The actuator as described in claim 1, wherein said body is sized for drop seating relative to an upper communication surface of said receiver.

10. The actuator as described in claim 1, said actuator bolt catch further comprising a tab shaped to be engaged by a follower of an attachable magazine of a firearm.

11. An actuator for establishing a bolt hold open condition in use with a firearm containing a reciprocating bolt within a receiver upon which said assembly is supported; said actuator further comprising:

a body exhibiting a perimeter defined open interior and which is adapted to being seated upon an upper surface of a receiver in proximity to an exposable location of an inner chamber containing said bolt; and an actuator bolt catch supported relative to an end of said body and being shaped to be vertically upwardly displaceable relative to the body to establish a bolt hold open condition, said actuator bolt catch including a window and a tab, the tab extending in a direction over the receiver inner chamber and which is adapted to being engaged by a follower of an attachable magazine for establishing a last shot hold open condition; and an adjustment screw incorporated into a bottom end location of said body and, upon rotating, vertically displacing said actuator bolt catch in either of opposite linear directions to modify a contact location established with a forward edge location of the follower, as well as correspondingly varying a seating location of the catch within the window.

12. An apparatus for use with a firearm, the apparatus comprising:

an actuator housing; and an actuator bolt catch, the actuator housing having a rectangular configuration with a first end and a second end connected by a pair of sides, the ends and sides of the actuator housing defining an open interior, the first end of the actuator housing defining slot sized to receive at least a portion of said actuator bolt catch, and the actuator housing being sized so the actuator housing is mountable to a firearm proximate an interior aperture of a magazine well and sized so that the open interior spans at least a portion of an interior aperture of a magazine well when said actuator is mounted to a firearm, and at least a portion of said actuator bolt catch being positioned in the slot of the actuator housing and said actuator bolt catch having at least a face orientated away from the open interior, the face including a recess, and the recess being sized to be engaged by a firearm bolt catch.

13. The apparatus of claim 12, wherein the open interior of the actuator housing defined by ends and sides of the actuator housing is sized to accommodate at least a portion of an attachable magazine for a firearm.

14. An apparatus comprising:

a firearm, and an adapter assembly, the firearm including an upper receiver, a lower receiver, a reciprocating bolt, a firearm bolt catch, and a magazine, the lower receiver including a magazine well having an internal aperture and an external aperture, and the magazine being inserted into said magazine well through said external aperture, and the adapter assembly including an actuator housing and an actuator bolt catch, the actuator housing having a rectangular configuration with a first end and a second end connected by a pair of parallel sides, the ends and sides of the actuator housing defining an open interior for the actuator housing, with the actuator housing being positioned on the firearm so that the open interior spans at least a portion of the internal aperture of the magazine well, and at least a portion of the magazine being received in the open interior, the internal aperture and the first end of the actuator housing also defining a slot dimensioned to receive the actuator bolt catch, which is positioned in the slot and having a face orientated away from the open interior and including a recess, and the recess being engaged by the firearm bolt catch.

15. The apparatus of claim 14, said firearm comprising a semi-automatic firearm.

16. The apparatus of claim 15, said semi-automatic firearm comprising an AR-15 type firearm.

17. The apparatus of claim 16, said AR-15 type firearm comprising at least one of an AR-15 or an M-16 firearm.

18. The apparatus of claim 14, wherein said magazine comprises a magazine including at least one rimfire cartridge.

19. The apparatus of claim 18, said rimfire cartridge comprises .22 caliber ammunition.

20. The apparatus of claim 14, the firearm further including a retractable charging handle for manually retracting the reciprocating bolt.

* * * * *